United States Patent [19]

Fierus et al.

[11] Patent Number: 5,018,310

[45] Date of Patent: May 28, 1991

[54] KNIFE SHARPENER

[76] Inventors: Udo Fierus; Gerd Fierus, both of Am Gierlichshof 10, D-5090 Leverkusen 3, Fed. Rep. of Germany

[21] Appl. No.: 440,761

[22] Filed: Sep. 18, 1989

[30] Foreign Application Priority Data

Sep. 29, 1988 [DE] Fed. Rep. of Germany ..... 3833065

[51] Int. Cl.[5] ..... B24B 3/36; B24B 3/54

[52] U.S. Cl. ..... 51/80 BS; 51/85 BS; 51/92 BS

[58] Field of Search ..... 51/74 BS, 77 BS, 80 BS, 51/83 BS, 84 BS, 85 BS, 81 BS, 92 BS, 285, 86 BS, 91 BS, 109 BS

[56] References Cited

U.S. PATENT DOCUMENTS 1,370,381 3/1921 Tarbox ..... 51/80 BS
2,617,235 11/1952 Lindahl ..... 51/80 BS
4,265,055 5/1981 Cartwright ..... 51/285 X
4,550,632 11/1985 Inman ..... 51/285 X
4,807,401 2/1989 Atwater ..... 51/285

*Primary Examiner*—Frederick R. Schmidt
*Assistant Examiner*—Bruce P. Watson
*Attorney, Agent, or Firm*—Young & Thompson

[57] ABSTRACT

A grinding device (2) is inserted in the synthetic resin housing (1) of the knife sharpener, this grinding device consisting of a supporting unit (3) with two resiliently designed supporting arms (6, 7) for two grinding wheels (8, 9). In the installed condition, the grinding wheels (8, 9) extend in sections and with a mutual spacing through slots (17, 18) in the housing wall (16) into a trough-like indentation (19) of the housing (1) accessible from the top. The two grinding wheels (8, 9) form, in the region of the indentation (19), by a partial overlap (20) with their peripheral surfaces (21, 22) a honing angle ($\alpha$) which is infinitely variable within a range of 40°–50°.

3 Claims, 2 Drawing Sheets

KNIFE SHARPENER

BACKGROUND OF THE INVENTION

The invention relates to a knife sharpener.

The disadvantages of the knife sharpener known from German Utility Model 1,986,392 are to be seen in that the user must take careful aim in order to target the oppositely located guide slots in the housing wall with the knife blade, that missing of the guide slots evokes danger of injuries inflicted by the knife sliding off the housing, that transverse grooves are produced in the ground faces of the knife blade above the cutting edge due to the chafing of the knife blade along the slot rims where abraded material from the grinding elements and the knife blades is deposited, these grooves impairing the cutting function and the appearance of the blade, that the normally flaring wedge angle of the blade is not uniformly resharpened on account of the characteristic that in most knives the blade thickness slightly increases from the handle to the knife point at the beginning of the cutting faces, that tempered knife blades are damaged during sharpening due to the cutting action of the grinding elements fashioned as steel rollers, that owing to the narrow width of the guide slots in the housing wall only household knives having thin blades can be sharpened, while industrial knives with thick blades cannot be sharpened thereby, and that on account of the spacing of the grinding elements with respect to the guide slots the knife blades cannot be sharpened all the way to the handle attachment.

SUMMARY OF THE INVENTION

The invention has the object of improving the knife sharpener of this type in such a way that uniformly good sharpening action is achieved over the entire length of the knife blade while avoiding transverse grooves in the ground faces of the knife blade, and the knife sharpener can be manipulated without hazards.

This object has been attained according to this invention by a knife sharpener having the features described hereafter.

The knife sharpener of this invention is distinguished by the following mode of operation and the advantages ensuing therefrom:

When sharpening knives having differing blade thickness at the onset of the cutting faces from the end of the blade on the handle side to the blade tip, the grinding angle formed by the two grinding wheels automatically follows the wedge angle of the cutting edge which changes over the length of the knife blade, thanks to the resilient mounting of the grinding wheels and the decreasing force which is exerted by the arm so that the blade is sharpened uniformly over the entire length. Furthermore, the user of the knife sharpener can adapt the honing angle of the sharpener to the wedge angle of the knife blade by exerting differing pressure on the blade, this wedge angle varying in most of the knives available on the market inasmuch as, during knife manufacture, the cutting faces of the knife blade are initially ground primarily manually by means of a grinding stone. Use of the knife sharpener in the household entails no dangers of injuries whatever. Upon introduction of the knife blades into the sharpener, the edge, in most cases, will not at the first attempt enter precisely centrally into the gap between the two grinding wheels so that the blade glides sometimes more vigorously, sometimes more glancingly along the periphery of the two grinding wheels; as a consequence, the grinding wheels execute differing rotary movements and thereby the annular sharpening surface of the wheels is utilized over the entire wheel circumference. On account of the resilient mounting of the grinding wheels and on account of the horizontal spacing thereof in the region of the wheel cover, the impression of transverse deformations, so-called "gouges", into the knife blade is avoided. Furthermore, the resilient mounting of the grinding wheels permits a gentle dipping of the blade, which latter must be introduced repeatedly into the opening between the grinding wheels during the sharpening operation, and affords a ready control of the counterpressure during pulling through of the blade whereby a smooth surface of the cutting faces is achieved. The trough-like depression of the housing in the region of the two grinding wheels makes it possible to sharpen differently thick household and industrial knives up to the grip attachment. The spacing between the two grinding wheels in the cover zone precludes a blade-destroying shear effect. Finally, the knife sharpener is distinguished by a simple, economical manufacture.

BRIEF DESCRIPTION OF THE DRAWINGS

The invention will be described in detail below with reference to an embodiment illustrated in the drawings wherein.

DETAILED DESCRIPTION OF THE PREFERRED EMBODIMENT

Figure 1:
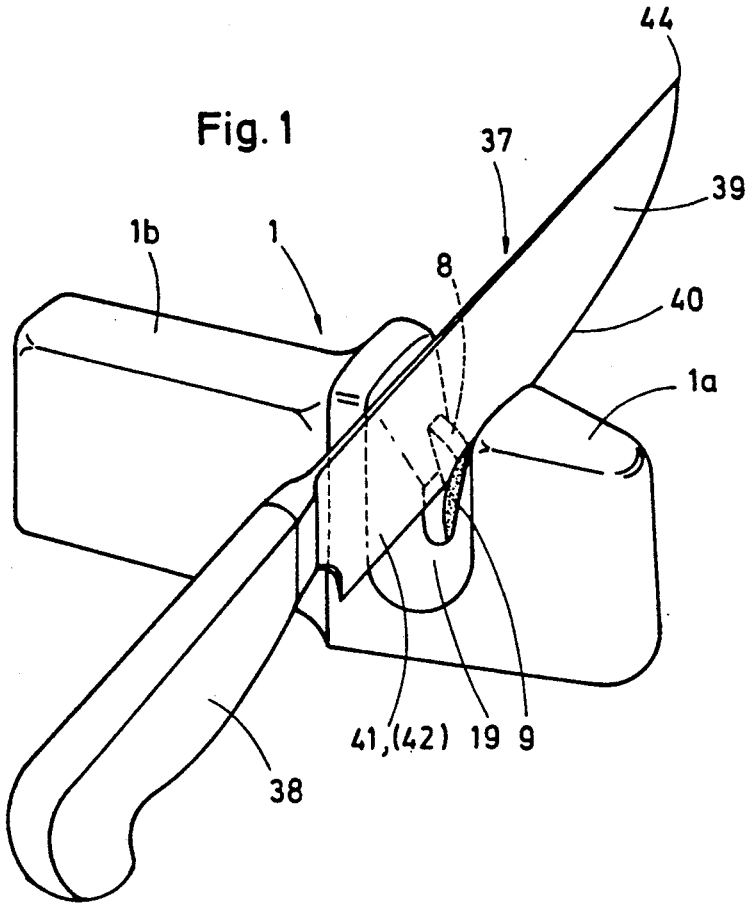
FIG. 1 is a perspective view of the knife sharpener with a knife in the sharpening position.
Figure 4:
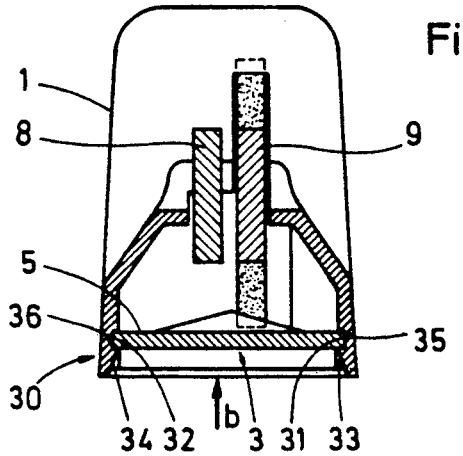
FIG. 4 is a cross sectional view of the knife sharpener along line IV—IV of FIG. 3.
Figure 2:
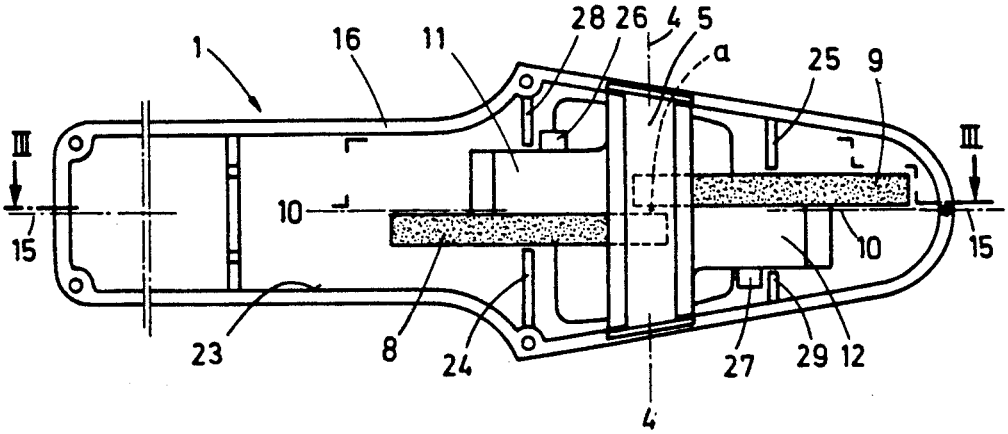
FIG. 2 shows a bottom view of the knife sharpener.
Figure 3:
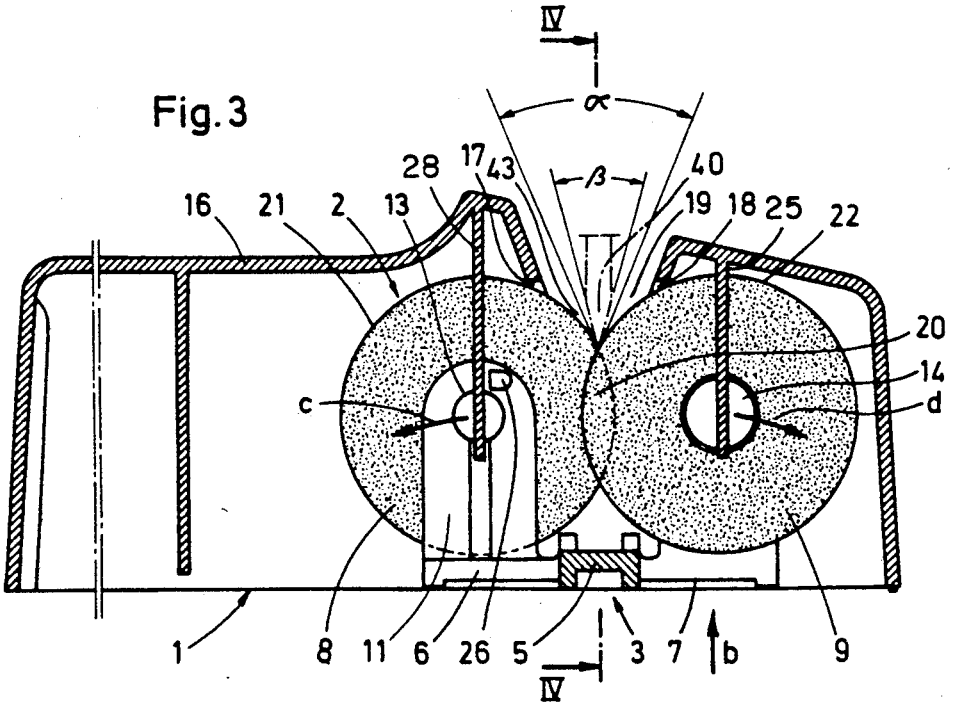
FIG. 3 shows a longitudinal section of the knife sharpener along line III—III in FIG. 2.

The knife sharpener comprises an elongated synthetic resin housing 1 segmented into a forwardly tapering section 1*a* to accommodate an externally accessible grinding device 2 and into a section 1*b* designed as a handle.

The grinding device 2 consists of a one-piece bracket 3 of a synthetic resin insertable in the housing 1 from the bottom and comprising a base plate 5 arranged in the direction of its transverse axis 4—4, the base plate including two supporting arms 6, 7, which show limited resiliency about the transverse axis 4—4 under the effect of a force, for two grinding wheels 8, 9 of an oxide ceramic material or sintered corundum. The oppositely oriented supporting arms 6, 7 having a flat-bar profile, extending on both sides of the center line 10—10 of the bracket 3 in parallel to and at a spacing from the center line, support two bearing blocks 11, 12 with transversely oriented hollow bearing pins 13, 14 for the attachment of the two rotatable parallel grinding wheels 8, 9 which latter are offset at equal spacing with respect to the center line 10—10 of the bracket 3.

In the installed condition, the central axis 10—10 of the bracket 3 is congruent with the central axis 15—15 of the housing 1, and the two grinding wheels 8, 9 extend in sections and with a mutual spacing a through slots 17, 18 in the housing wall 16 into a trough-like indentation 19 of the housing 1 accessible from the top. The two cylindrical grinding wheels 8, 9 form, in the zone of the indentation 19, by a partial overlap 20 with their peripheral surfaces 21, 22, a passage having a grinding angle $\alpha$ which is infinitely variable within a certain range by the action of force on the knife blade 39.

Retaining ribs 24, 25, arranged on the inner wall 23 of the housing 1, securely hold the grinding wheels 8, 9 on the bearing trunnions 13, 14 of the bearing blocks 11, 12 of the bracket 3.

Stop pins 26, 27 are integrally molded to the bearing blocks 11, 12 of the bracket 3; these stop pins cooperate with counter ribs 28, 29 on the inner wall 23 of the housing 1 for limiting the resiliency of the supporting arms 6, 7 of the bracket 3.

A snap lock 30 permits rapid and easy installation of the grinding device 2 in the housing 1. During the assembly of the knife sharpener, the bracket 3 with the grinding wheels 8, 9 pointing into the insertion direction b is slid from the bottom into the housing 1. At the end of the insertion movement, the holding webs 31, 32 projecting at the ends of the base plate 5 of the bracket 3 slide along inclined guides 33, 34 molded on the inner wall 23 of the housing 1 and lock into place in undercut portions 35, 36 behind the inclined guides 33, 34 in the inside wall 23 of the housing 1.

In order to sharpen a knife 37, the latter is grasped by the handle 38, the blade 39 is introduced with the end on the handle side into the indentation 19 of the housing 1, so that the curved knife edge 40 with the two cutting faces 41, 42 enters into the opening 43 between the two grinding wheels 8, 9, and the cutting edge 40 is pulled through between the grinding wheels 8, 9 up to the knife tip 44. This sharpening step can be repeated several times. Upon introduction of the end of the knife cutting edge 40 on the handle side into the opening 43 between the two grinding wheels 8, 9, the latter are resiliently urged apart somewhat toward the directions of arrows c, d under the action of force whereby initially a honing angle B of, for example, approximately 45° is formed between the wheels. With progressive pulling motion of the knife blade 39 passing between the grinding wheels 8, 9, the force exerted by the arm on the blade 39 automatically decreases on account of the increasing lever arm between the handle 38 and the support of the knife cutting edge 40 between the grinding wheels 8, 9, so that the grinding wheels 8, 9 continuously move toward each other resiliently up to a honing angle $\alpha$ of about 50° at the knife tip 44. In this way, the honing angle $\alpha$ of the grinding wheels 8, 9 is made to follow the wedge angle $\beta$ of the cutting edge 40 which becomes more obtuse from the end on the handle side to the knife tip; consequently, the cutting edge is uniformly resharpened over the entire length.

In a modification of the aforedescribed embodiment of the knife sharpener, the bracket for the grinding wheels can be attached in the housing by means of self-tapping screws, the latter penetrating the base plate of the bracket and being threaded into thickened portions in the inner housing wall.

What is claimed is:

1. A non-powered knife sharpener having two round grinding elements which are rotatably supported in a synthetic resin housing underneath a passage opening in the housing wall, the grinding elements having parallel axes of rotation and are offset with respect to each other, these grinding elements forming, by a partial overlapping, a passage with an acute honing angle for a knife blade, a one piece bracket of a synthetic resin insertable in the housing from the bottom, the central axis of the bracket is in alignment with the central axis of the housing in the installed condition, said bracket comprising a base plate arranged in the direction of a transverse axis of the housing which is perpendicular to the central axis of the housing, said bracket having two oppositely directed supporting arms of a flat bar profile, which arms have limited resiliency about the transverse axis and extend on both sides of the central bracket axis in parallel relation thereto and at a spacing therefrom, two bearing blocks supported on the support arms offset from the transverse axis, said bearing blocks having transversely orientated bearing pins for the attachment of said two grinding elements offset with respect to the central axis at equal distances on either side, said grinding elements overlapping in the direction of the transverse axis and having a mutual space therebetween, said grinding elements extending through slots in the housing wall into a trough-like indentation of the housing accessible from above, and the peripheral surfaces of these grinding elements forming a passage in the region of the indentation with a grinding angle that is infinitely variable within a certain range by deformation of said arms upon exertion of force upon the grinding elements by a knife blade.

2. Knife sharpener according to claim 1, further comprising stop pins (26, 27) integrally formed on the bearing blocks (11, 12) of the bracket (3) and cooperating with counter ribs (28, 29) on the inner wall (23) of the housing, for limiting the resilient motion of the supporting arms (6, 7) of the bracket (3).

3. Knife sharpener according to claim 1 having an adjustability of the honing angle ($\alpha$) of between 40° and 50°.

* * * * *